US009445683B1

(12) United States Patent
Rochin

(10) Patent No.: US 9,445,683 B1
(45) Date of Patent: Sep. 20, 2016

(54) TRAVERSE ROD AND HARDWARE SYSTEM

(71) Applicant: Robert D. Rochin, Vista, CA (US)

(72) Inventor: Robert D. Rochin, Vista, CA (US)

( * ) Notice: Subject to any disclaimer, the term of this patent is extended or adjusted under 35 U.S.C. 154(b) by 0 days.

(21) Appl. No.: 14/493,692

(22) Filed: Sep. 23, 2014

(51) Int. Cl.
*A47H 15/00* (2006.01)
*A47H 1/04* (2006.01)
*A47H 5/02* (2006.01)

(52) U.S. Cl.
CPC . *A47H 1/04* (2013.01); *A47H 5/02* (2013.01)

(58) Field of Classification Search
CPC ..... Y10T 16/354; Y10T 16/3543; Y10T 16/376; Y10T 16/379; Y10T 16/35; Y10T 16/373; E05Y 2201/684; E05Y 2201/644; E05Y 2201/646; E05Y 2201/668; E05Y 2900/108; E05Y 2900/114; E05D 15/06; E05D 15/0652; E05D 15/0626; E05D 15/063; E05D 15/0643; E05D 15/0647; E05D 15/165; E05D 15/0215; A47H 1/02; A47H 1/04; A47H 1/10; A47H 1/102; A47H 1/104; A47H 2001/0215; A47H 2001/021; A47H 2001/047; A47H 515/00; A47H 515/02; A47H 515/04; A47H 23/00; A47H 5/02
See application file for complete search history.

(56) References Cited

U.S. PATENT DOCUMENTS 592,795 A * 11/1897 Leslie ..... 16/89
1,662,928 A * 3/1928 Kirsch ..... A47H 1/142 16/93 D
1,808,628 A * 6/1931 Bond ..... A47H 1/104 248/214
2,007,580 A * 7/1935 Menge ..... B44C 5/00 16/87.2
3,342,344 A * 9/1967 Magnuson ..... A47G 25/0692 16/87.4 R
3,504,805 A * 4/1970 Doyle ..... A47H 1/022 138/109
4,141,105 A * 2/1979 Gonon ..... A47H 13/02 16/87.6 R
4,190,927 A * 3/1980 Hepperle ..... A47H 1/00 16/106
6,499,708 B1 * 12/2002 Cowen ..... A47H 5/02 16/87.2
7,237,303 B2 * 7/2007 Schorling ..... A47H 1/142 16/87.2
7,987,532 B2 * 8/2011 Bathurst ..... A47K 3/30 4/557
8,544,148 B2 10/2013 Keishold
2005/0022950 A1 * 2/2005 Putman ..... A47H 5/04 160/330
2005/0055800 A1 * 3/2005 Meech ..... A47H 1/10 16/87.4 R
2010/0269986 A1 * 10/2010 Chen ..... A47H 23/04 160/127
2011/0062099 A1 * 3/2011 McCormack ..... A47H 15/02 211/124
2011/0225774 A1 * 9/2011 Seddon ..... A47H 1/02 16/94 D
2011/0283479 A1 * 11/2011 Peters ..... A47H 1/04 16/87.2
2012/0198655 A1 * 8/2012 Lapping ..... E04H 15/18 16/91

* cited by examiner

*Primary Examiner* — Chuck Mah
(74) *Attorney, Agent, or Firm* — San Diego IP Law Group LLP

(57) ABSTRACT

The present invention provides an improved traverse rod and hardware system that utilizes one or more load bearing trolleys housed within a hollow traverse rod. The traverse rod is a tube having an opening or slot across a top or top surface of the tube. The trolleys are attached to one or more connectors such as rings, which partially or completely encircle the tube and connect to a hanging object such as but, not limited to a curtain or drape. The trolleys move within the tube through the exercise of a cord and pulley system. The bottom or bottom surface of the tube bears the weight of the hanging objects through the trolleys and respective connector.

11 Claims, 10 Drawing Sheets

TRAVERSE ROD AND HARDWARE SYSTEM

BACKGROUND OF THE INVENTION

1. Field of Invention

The present invention relates generally to window (or any type of opening) treatments and more particularly to a traverse rod and hardware system to easily maneuver hanging objects such as, but not limited to curtains, drapes, tapestries, coverings, or any other hanging objects.

2. Description of Related Art

Traverse rods are generally used to support and manipulate hanging objects relative to a window or opening (e.g., room or stage). Hanging objects include, but are not limited to curtains, drapes, tapestries, and coverings. A traverse rod is utilized as part of a larger system that allows a user to manipulate the hanging objects without directly touching the hanging objects themselves. For example, a cord, wand, or motor may be used to move one or more hanging objects along a traverse rod in various directions. When maneuvering hanging objects, conventional traverse rod system may be subject to internal friction among contacting surfaces, thereby creating undesired noise and damage to aesthetic surfaces.

Hanging objects exist in various height and lengths depending on the window or opening being covered. Long hanging objects can be heavy and thus, require a sturdy and rigid traverse rod—therefore metal is preferable. For wide windows or openings, a traverse rod may need to be affixed (via brackets) to a wall at three or more locations—intermediate locations hinder movement of the hanging object pass these fixtures, thereby preventing continuous movement of the hanging object.

U.S. Pat. No. 8,544,148 to Keishold, the entire disclosure of which is incorporated by reference herein, discloses a traverse rod system 10 comprising a hollow tube 12, which has an opening 15 along its top surface. One or more cord carriers 20 are disposed within the tube 12 and each cord carrier 20 is attached (at the opening 15) to one or more rings 14, which completely or partially encircle the tube 12. First and second longitudinal edges 17, 19 of the tube form a bearing surface upon which the rings 14 may rest. In other words, the rings 14 contact and slide along the top surface of the tube. One or more edge guards 36 may envelope each of the first and second edges 17, 19. The edge guards 36 allegedly create a smooth, low-friction bearing surface upon which the rings 14 may glide, thereby protecting the tube 12 against damage from protracted use. One drawback of Keishold, among others, is the location of the load bearing surface at the top surface of the tube 12. Because the rings 14 (and hence the weight of the hanging objects) rest on the top outside surface of the tube 12, noise created by sliding the rings 14 along the tube is unrepressed with or without the guards 36. Moreover, Keishold's design has a fixed and permanent separation between rings 14, which is aesthetically undesirable when respective hanging objects are fully opened.

Accordingly, there exists a need for a traverse rod system that moves the load bearing surface away from the top of the respective traverse rod.

SUMMARY OF THE INVENTION

The present invention overcomes these and other deficiencies of the prior art by providing an improved traverse rod and hardware system that utilizes one or more load bearing trolleys housed within a hollow traverse rod. The traverse rod is a tube having an opening or slot across a top or top surface of the tube. The trolleys are attached to one or more connectors such as rings, which partially or completely encircle the tube and connect to a hanging object such as but, not limited to a curtain or drape. The trolleys move within the tube through the exercise of a cord and pulley system. The bottom or bottom surface of the tube bears the weight of the hanging objects through the trolleys and respective connectors.

In one embodiment of the present invention, a traverse rod system for one or more hanging objects, the traverse rod system comprising: a tube having an opening slot disposed along its top surface; and a first trolley disposed within the tube, wherein the first trolley is configured to move back and forth within the tube, the first trolley bearing weight of the one or more hanging objects at a bottom inner surface of the tube. The first trolley comprises a sled, a bearer, a ring, and a connector, wherein the sled is in contact with the bottom inner surface of the tube, the bearer is adjoined to the sled, the ring is adjoined to the bearer and at least partially encircles the tube, and the connector is adjoined to a bottom of the ring. The bearer, the ring, and the connector do not make contact with the tube. The ring is selected from the group consisting of: a circular ring, a square shaped ring, a square shaped ring with rounded corners, a rectangular shaped ring, a rectangular shaped ring with rounded corners, and an oval ring. The bearer extends through the opening slot. The connector comprises one or more holes that can be used for attaching the one or more hanging objects. The tube is selected from the group consisting of: a cylindrical tube, a square shaped tube, a square shaped tube with rounded corners, a rectangular shaped tube, and a rectangular shaped tube with rounded corners. The tube comprises a tongue configured to attach to one or more wall attachments. The sled can comprise one or more wheels and a post at each end, each post having a raise strip that fits within the opening slot of the tube. The bearer can be disposed in between the posts or outside the posts. A drapery ring may be included, wherein the draper ring comprises a bearer and a wheel coupled to the bearer, the wheel being able to freely move along the inner bottom surface of the tube.

An advantage of the present invention is that the load, i.e., weight, of the hanging objects is placed on a bottom inside surface of the traverse rod. This feature suppresses any noise caused by movement of hanging objects along the traverse rod system. This feature also eliminates the need for edge guards along the slot across the top of the traverse rod.

The foregoing, and other features and advantages of the invention, will be apparent from the following, more particular description of the preferred embodiments of the invention, the accompanying drawings, and the claims.

BRIEF DESCRIPTION OF THE DRAWINGS

For a more complete understanding of the present invention, the objects and advantages thereof, reference is now made to the ensuing descriptions taken in connection with the accompanying drawings briefly described as follows.

DETAILED DESCRIPTION OF PREFERRED EMBODIMENTS

Preferred embodiments of the present invention and their advantages may be understood by referring to FIGS. 1-9. The present invention is described in the context of a traverse rod system and hardware for hanging one or more curtains. However, one of ordinary skill in the art readily appreciates that that the present traverse rod system and hardware can be utilized for any type of hanging objects such as, but not limited to drapes, tapestries, blinds, and coverings.

As described below and shown in the accompanying figures, the present invention is novel and nonobvious as it employs a hollow traverse rod having one or more load bearing trolleys (or "trolleys" for short) that move inside and within the rod. Each trolley is attached to one or more connectors, which are coupled to a curtain. Movement of the trolleys within the rod by, for example, a user or motor exercising a cord and pulley system, moves the respective curtains. The trolleys can move in the same direction or in opposite directions depending on the desired movement of the respective curtain(s).

Figure 1:
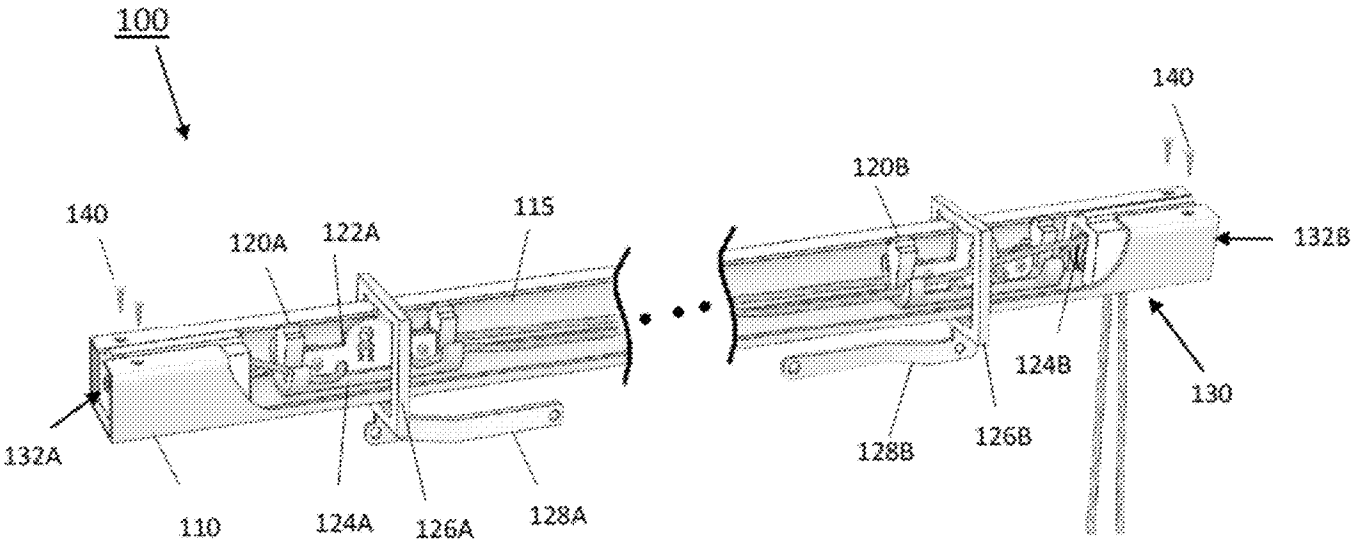
FIG. 1 illustrates a traverse rod system according to an embodiment of the invention.

FIG. 1 illustrates a traverse rod system 100 according to an embodiment of the invention. Particularly, the traverse rod system 100 comprises a tube 110, two trolleys 120A and 120B, and a pulley and cord system 130. One of ordinary skill in the art appreciates that any number of trolleys 120 can be implemented depending on, for example, the length of tube, the weight of the curtains, and the direction of desired movement of the curtains. Nonetheless, a typical system comprises two trolleys 120A and 120B as shown. The tube 110 includes a slot or opening 115 along its top surface (much of the slot is obscured by the cut away in this figure and is better shown in FIG. 5A). The term "tube" is used as shorthand and is not intended to limit itself to a cylindrical shape. Instead, the cross-section of the tube 110 can be any shape such as, but not limited to square as shown (with or without rounded edges), rectangular (with or without rounded edges), oval, or circular, and can include optional aesthetic decorations. The tube 110 can be as long as desired. Preferably, the tube 110 is constructed from a lightweight, but rigid metal such aluminum. However, one of ordinary skill in the art appreciates that other types of tube materials can be employed such as, but not limited to other metals, wood, plastics, or composites so long as the material is capable of providing the necessary rigidity and load bearing characteristics needed to hang the respective curtains connected thereto.

Each trolley 120A or 120B comprises a respective bearer 122A or 122B, a sled 124A or 124B, a ring 126A or 126B, and a connector 128A or 128B. Referring to trolley 120A (but equally applicable to trolleys 120B, 120C, or 120D), the bearer 122A is affixed to the sled 124A and to the ring 126A. The sled 124A slides along the inside bottom surface of the tube 110 and is preferably manufactured from a high strength, lightweight, stiff, and fatigue resistant material, the identification of which is apparent to one of ordinary skill in the art. For example, low friction mechanical plastics such as cast molded polyurethane or injection molded polyethylene can be utilized as the sled 124A. Alternatively, the sled 124A may comprise a metal such as aluminum or steel. Optionally, the underside of the sled 124A (i.e., the surface in contact with the tube 110) may be coated with a low friction coating such as Teflon. The sled 124A can be appropriately shaped to match the cross-section shape of the tube 110 to mitigate and preferably prevent side to side movement (i.e., movement perpendicular to the axis of the tube 110). The sled 124A is coupled to the bearer 122A via glue (not shown) or fasteners such as rivets 125 (which are shown better in FIG. 3). The bearer 122A, ring 126A, and connector 128A are rigid and can be constructed from metal. In an embodiment of the invention, each end of a sled 124A comprises a post (e.g., two posts 125A are included in sled 124A and two posts 125B are included in sled 124B). At the top of each post 125A or 125B is a raised strip or "mohawk" the fits within opening 115 in order to prevent twisting movement of each trolley 120A or 120B as it slides through the tube 110.

The term "ring" is used as shorthand and is not intended to limit itself to a circular shape. Instead, the ring 126A can be any shape such as, but not limited to square (with or without rounded edges), rectangular (with or without rounded edges), oval, or circular, and can include optional aesthetic decorations. The bearer 122A is joined to the ring 126A through the opening 115. The connector 128A comprises holes for fastening a curtain thereto. For example, drapery hooks (not shown), the implementation of which is apparent to one of ordinary skill in the art, are used to attach curtains to the connectors 128A. Alternatively, the connector 128A can utilize other curtain fasteners, the implementation and identification of which are apparent to one of ordinary skill in the art. The bearer 122A transfers the weight of the curtain to the sled 124A, and hence the bottom of tube 110, through the ring 126A and connector 128A. Thus, these parts need to be sturdy and rigid for heavy hanging objects.

Figure 2A:
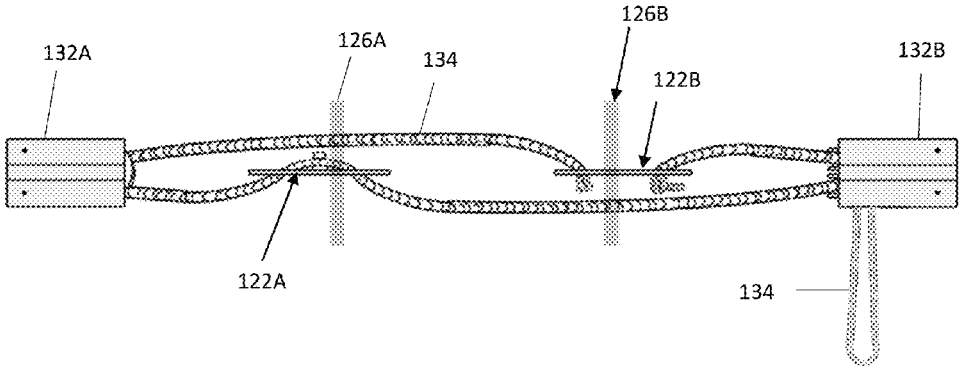
FIG. 2A illustrates a top view of the traverse rod system shown in FIG. 1, with the tube removed.
Figure 2B:
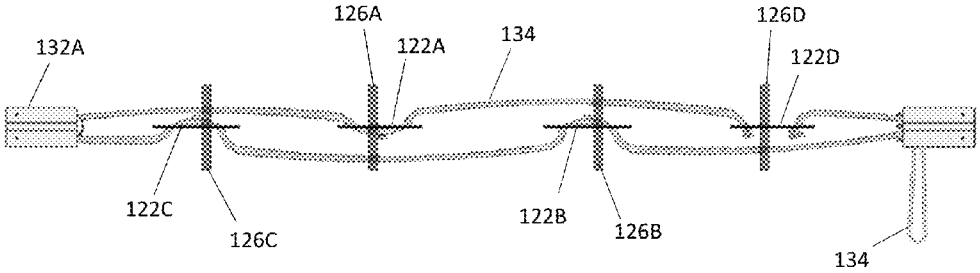
FIG. 2B illustrates a top view of the traverse rod system shown in FIG. 1, with two additional trolleys and the tube removed.

The pulley system 130 comprises pulley system ends 132A and 132B and a cord 134. Referring to FIG. 2A, the cord 134 is looped through trolley 120A 122A and tied to trolley 120B as shown. If more than two trolleys are employed, the cord 134 would be looped through those additional trolleys. For example, referring to FIG. 2B, the cord 134 is looped through two additional trolleys 120C and 120D. Trolley 120C moves in the same direction as trolley 120A. Trolley 120D moves in the same direction as trolley 120B. Each pulley system end 132A and 132B utilizes a number of pulleys, the implementation of which is apparent to one of ordinary skill in the art. During installation of the traverse rod system 100, the trolleys 120A and 120B (and others such as 120C and 120D if present) are inserted through the open ends of the tube along with the cord 134 and adjusted for the proper location along the tube 115. The pulley system ends 132A and 132B are then placed at each respective end of the tube 110 and fastened thereto through, for example, screws 140.

In an exemplary embodiment of the invention, the system 100 hangs a set of curtains, i.e., two drapes. One drape is hung on the left side of system 100 (between end 132A and ring 126A) and the other drape is hung on the right side of system 100 (between ring 126B and end 132B). One corner of each drape is attached to connector 128A or 128B via two drapery hooks. One or more drapery rings or clips (not shown), the implementation and identification of which are apparent to one of ordinary skill in the art, are also included to attach the remaining length of each of drape. For example, one or more drapery rings or clips are placed on the tube 110 between the ring 126A and its respective end 132A as well as between the ring 126B and its respective end 132B to support the weight of each drape. These drapery rings or clips are permitted to freely slide along the tube 110.

Figure 3:
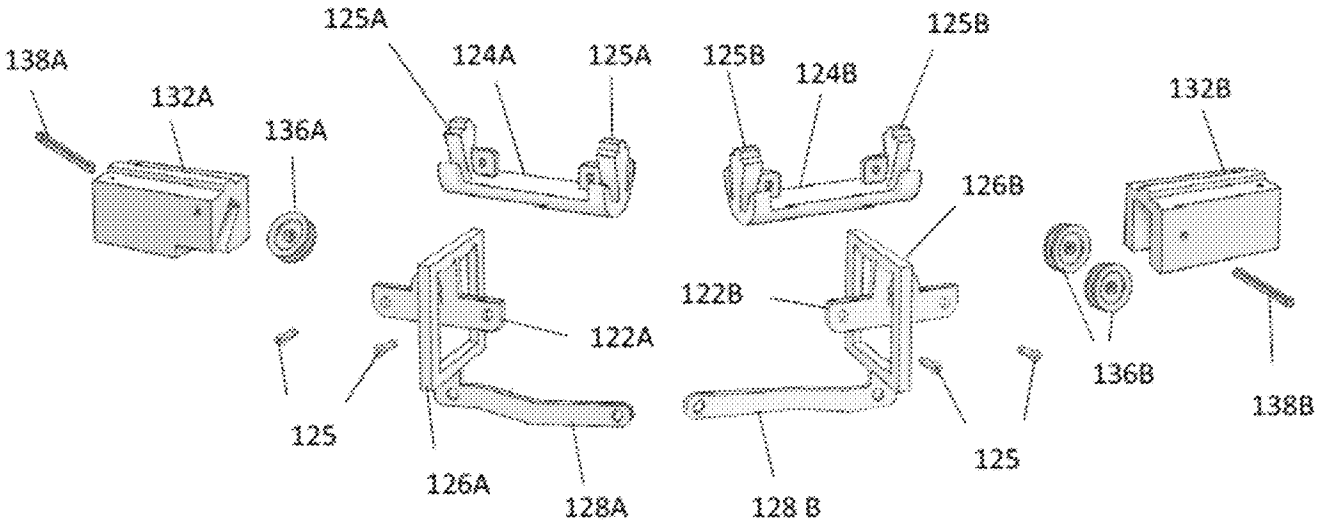
FIG. 3 illustrates an exploded view of the trolleys and pulley system ends shown in FIG. 1.

In operation, the cord 134 maneuvers the trolleys 120A and 120B, thereby maneuvering the attached curtains, respectively. The cord 134 is supported by the trolleys 120A and 120B, and pulley system ends 132A and 132B. Referring to FIG. 3, the pulley system end 132A comprises a pulley wheel 136A held in place by a pin 138A. Here, the pulley wheel 136A is angled to facilitate better movement of the cord 134 and trolleys 120A and 120B. The pulley system end 132B comprises two pulley wheels 136B held in place by a pin 138B. The cord 134 is used to maneuver the trolleys 120A and 120B through the tube 110. In an exemplary embodiment of the invention, movement of the cord 134 in one direction moves the trolleys 120A and 120B toward each other, thereby closing respective curtains. Movement of the cord 134 in an opposite direction moves the trolleys 120A and 120B away from each other, thereby opening the respective curtains. The cord 134 may be implemented by a person or can be connected to an electric motor, the implementation of which is apparent to one of ordinary skill in the art. The connectors 128A and 128B are configured to overlap with each other when the trolleys 120A and 120B are fully moved toward each other, thereby allowing the respective curtains to overlap each other and prevent light from passing through.

Figure 4:
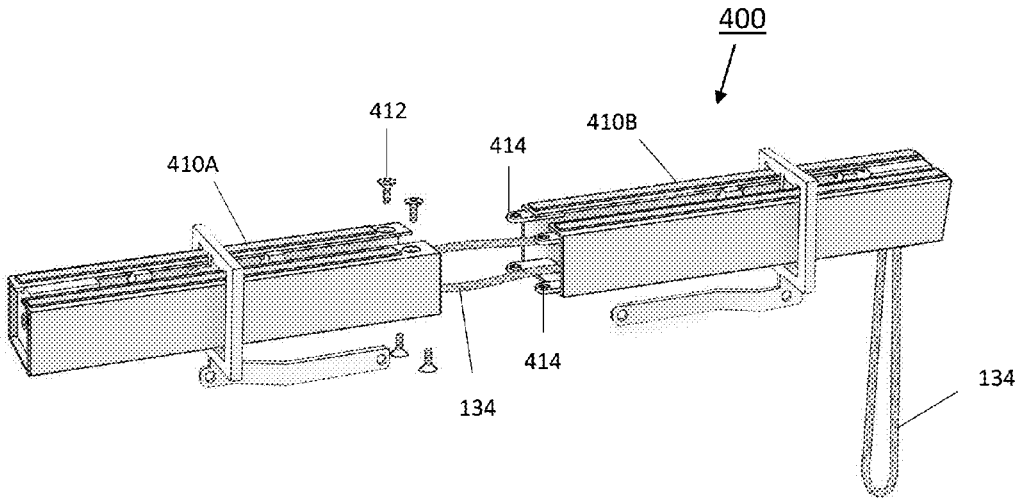
FIG. 4 illustrates a traverse rod system according to an embodiment of the invention.
Figure 5D:
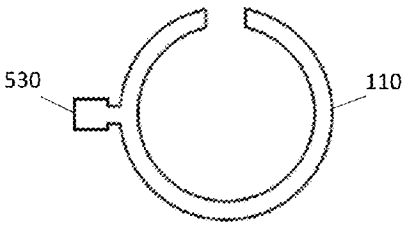
FIG. 5D illustrates a cross-sectional view of a traverse rod system according to an embodiment of the invention, with a square shape tongue.
Figure 5C:
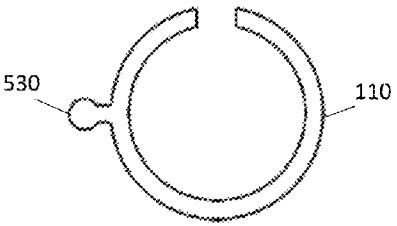
FIG. 5C illustrates a cross-sectional view of a traverse rod system according to an embodiment of the invention, with a round shape tongue.
Figure 5B:
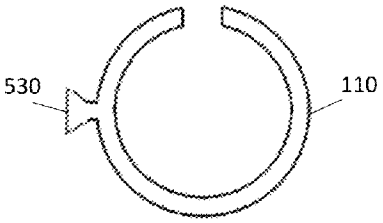
FIG. 5B illustrates a cross-sectional view of a traverse rod system according to an embodiment of the invention, with a triangle shape tongue.
Figure 5A:
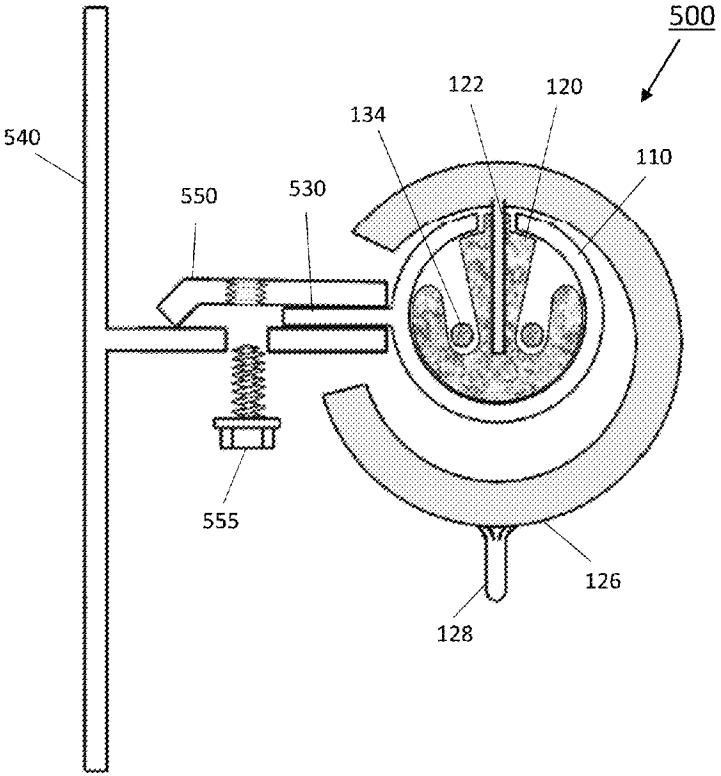
FIG. 5A illustrates a cross-sectional view of a traverse rod system according to an embodiment of the invention.

FIG. 4 illustrates a traverse rod system 400 according to an embodiment of the invention. Here, the traverse rod system 400 comprises all of the components of system 100 except that the tube 110 is constructed from two sections 410A and 410B, which are joined together through screws 412 and screw receptors 414. This configuration provides a simpler method to install trolleys 120A and 120B within the tube 110. Once the trolleys 120A and 120B are placed with the tube 110, the two sections 410A and 410B are joined.

FIG. 5 illustrates a cross-sectional view of a traverse rod system 500 according to an embodiment of the invention. Here, referring to FIG. 5A, the tube 110 is circular in shape although other shapes can be used as noted above. The tube 110 is coupled to a tongue 530, which can comprise metal welded to the tube 110. The tongue 530 is secured to a wall attachment 540 via a plate 550 and screw 555 as shown. Referring to FIG. 5B, FIG. 5C, and FIG. 5D, the end of the tongue 530 may take various shapes such as, but not limited to a square shape, a rounded shape, or a triangle shape, to improve the clamping between plate 550 and wall attachment 540, which themselves can be adapted in shape to better secure a respectively shaped tongue 530. The wall attachment 540 can be affixed to a wall via screws (not shown) or any type of appropriate attachment hardware, the identification and implementation of which is apparent to one of ordinary skill in the art. In an embodiment of the invention, an optional gliding strip (not shown) such as Teflon may be used to prevent contact between the trolley 120 and bottom inside surface of the tube 110.

Figure 6:
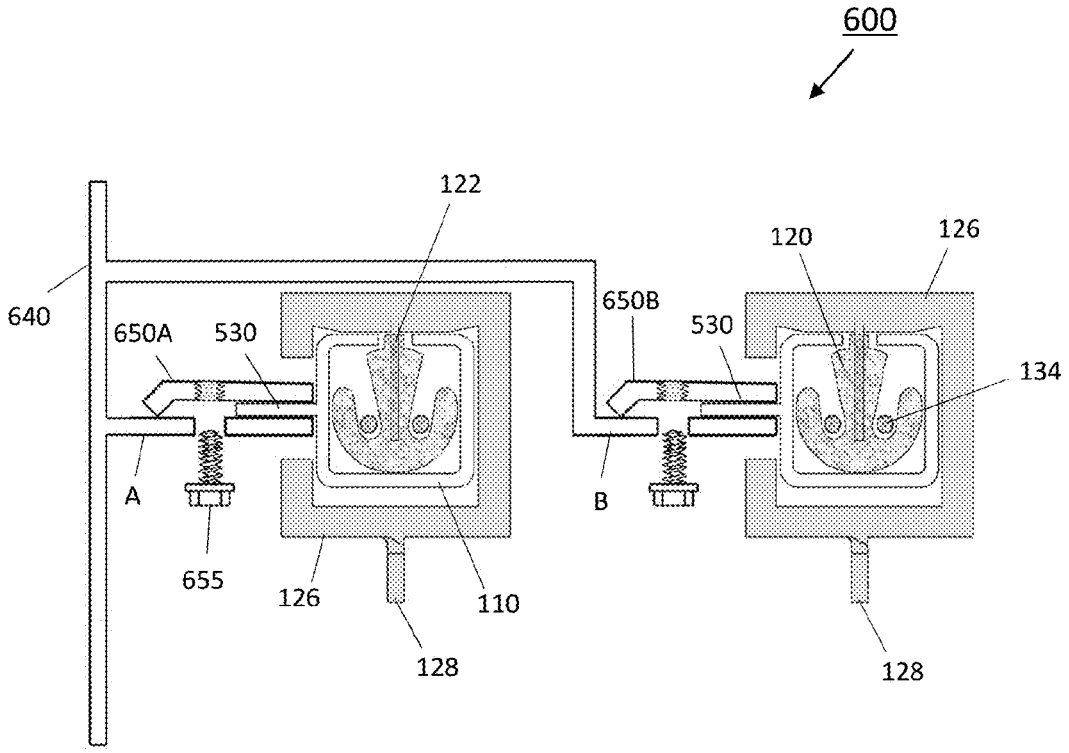
FIG. 6 illustrates a cross-sectional view of a traverse rod system according to an embodiment of the invention.

FIG. 6 illustrates a cross-sectional view of a traverse rod system 600 according to an embodiment of the invention. Here, two tubes 110 are employed—each tube 110 is square with rounded corners and supports one or more hanging objects. A wall attachment 640 is provided that has two arms A and B for attaching one of the two tubes 110. The tongue 530 of one tube 110 is secured to arm A via a plate 650A and screw 655. The tongue 530 of the other tube 110 is secured to arm B via a plate 650B and screw 655. The rings 126 in this embodiment are square in shape and do not completely encircle the tube 110 in order to allow movement of such pass the wall attachment 640.

Figure 7:
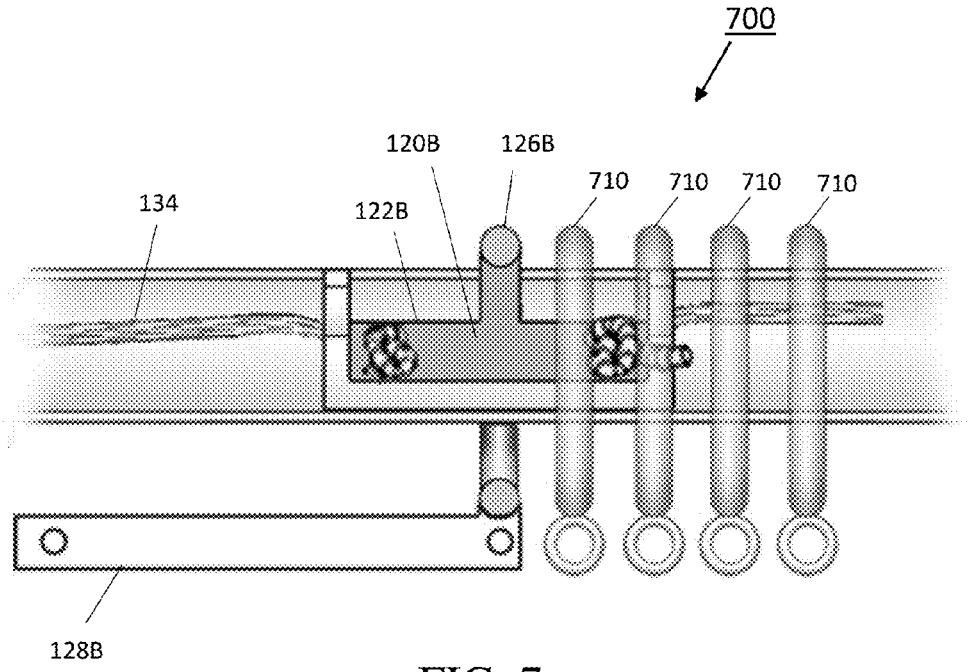
FIG. 7 illustrates a cross-sectional view of a traverse rod system according to another embodiment of the invention.

FIG. 7 illustrates a cross-sectional view of a traverse rod system 700 according to another embodiment of the invention. Here, four (4) drapery rings or clips 710, the implementation of which is apparent to one of ordinary skill in the art, are included along with trolley 120B to attach the entire top length of a drape.

Figure 8:
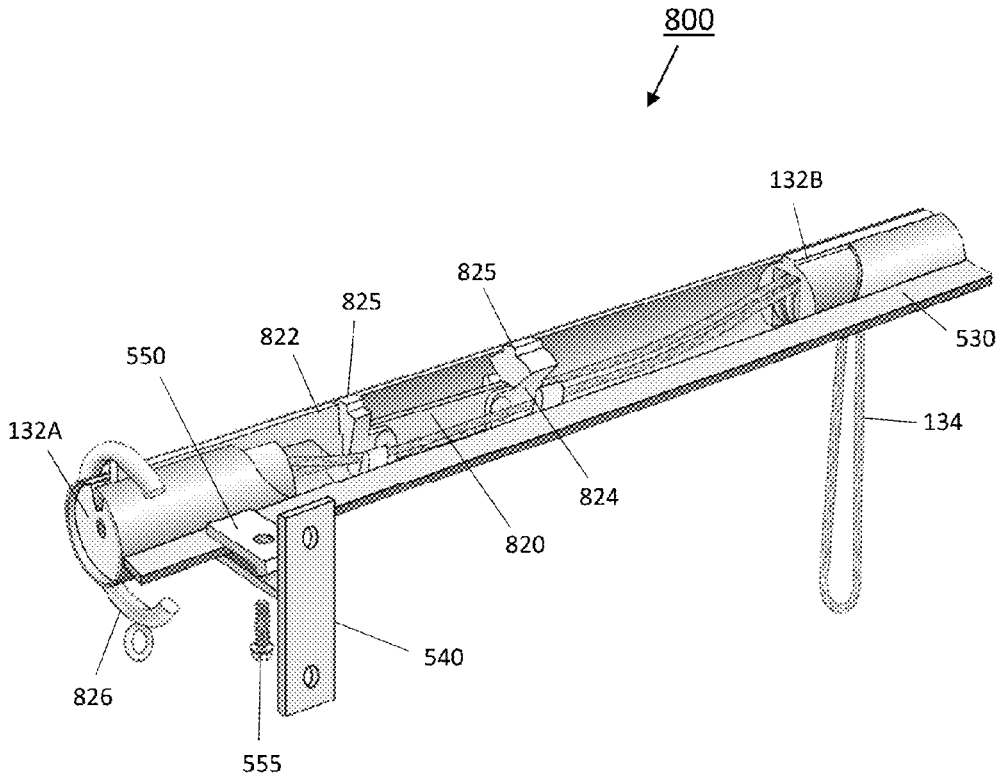
FIG. 8 illustrates a cut away perspective view of a traverse rod system according to another embodiment of the invention.

FIG. 8 illustrates a cut away perspective view of a traverse rod system 800 according to another embodiment of the invention. Here, the traverse rod system 800 is used to hang a curtain, the end of which can move to the pulley system end 132A. In this instance, a curtain can be pulled to the end of the tube 110, which may be useful if pulley system end 132A borders a side wall, i.e., a wall perpendicular to a wall by which wall attachment 540 would be mounted. In system 800, a single trolley 820 is employed and comprises sled 824, tower 825, and ring 826 similar to trolley 120. However, in this system 800, bearer 822 is not located between towers 825, but outside the left tower 825 so that ring 826 abuts a side wall.

Figure 9A:
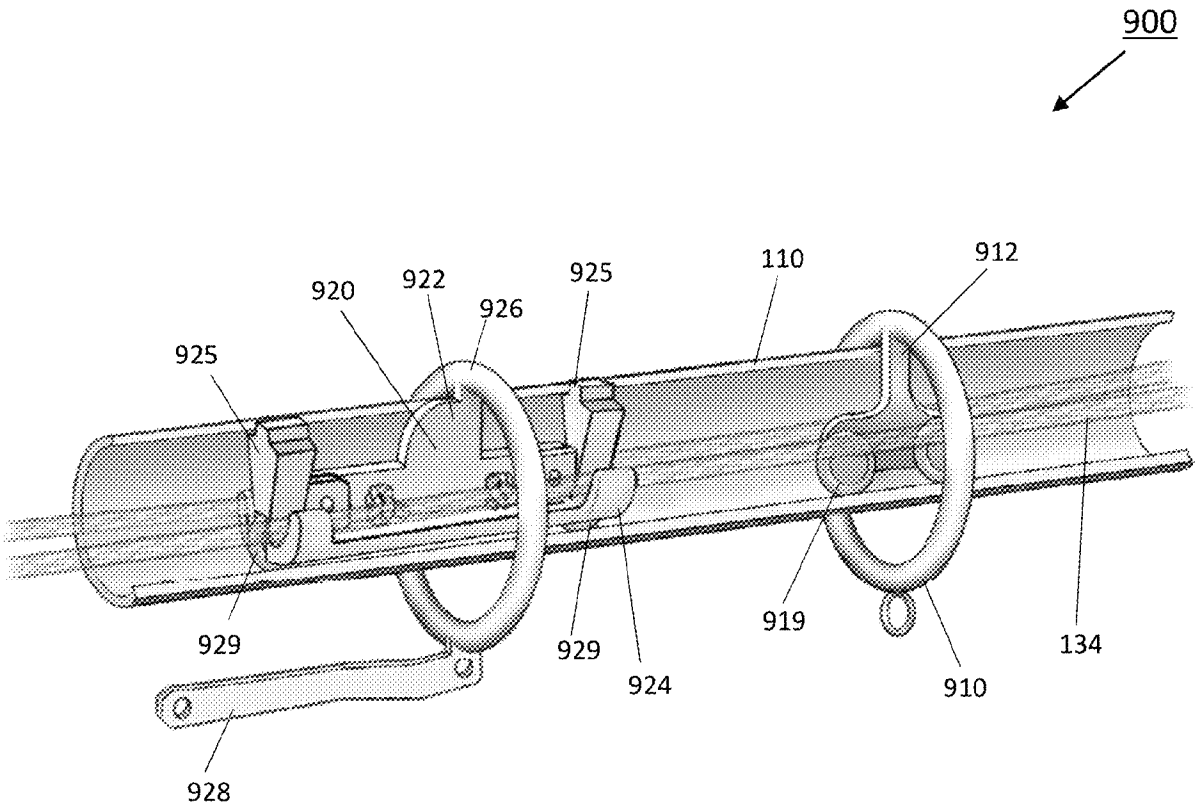
FIG. 9A illustrates a cut away perspective view of a traverse rod system according to another embodiment of the invention.
Figure 9B:
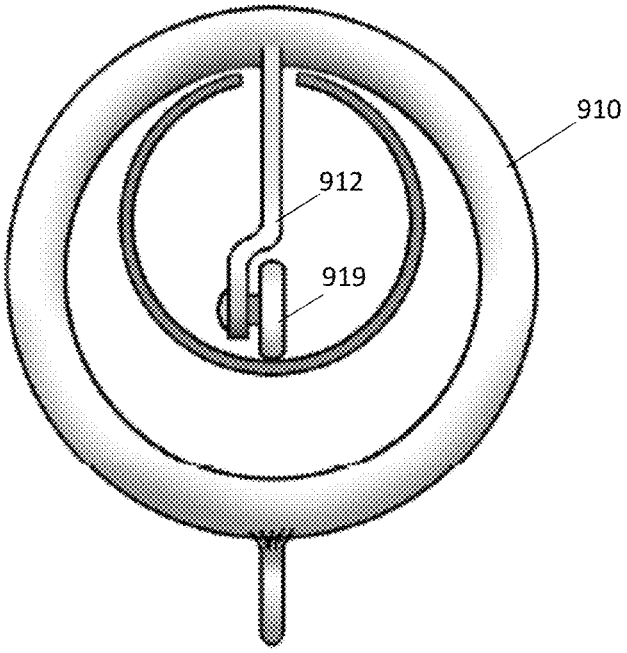
FIG. 9B illustrates a side view of a drapery ring of a traverse rod system according to another embodiment of the invention.

FIG. 9A illustrates a cut away perspective view of a traverse rod system 900 according to another embodiment of the invention. Here, a rolling trolley 920 is used. Referring to FIG. 9A, the rolling trolley 920 comprises a bearer 922, a sled 924, a ring 926, and a connector 928 similar to trolley 120. However, in this embodiment, sled 924 includes wheels 929, which contact the inners surface of tube 110 and permit free movement of the trolley 920. These wheels 929 also bear a portion of the weight of the hanging object. Any type of wheel may be used, the identification and implementation of which is apparent to one of ordinary skill in the art. The system 900 further includes a novel drapery ring 910, which comprises a bearer 912 coupled to wheels 919. The wheels 919 permit free movement of the drapery ring 910 and also bear a portion of the weight of the hanging object. A side view of the drapery ring 910 is shown in FIG. 9B.

The invention has been described herein using specific embodiments for the purposes of illustration only. It will be readily apparent to one of ordinary skill in the art, however, that the principles of the invention can be embodied in other ways. Therefore, the invention should not be regarded as being limited in scope to the specific embodiments disclosed herein, but instead as being fully commensurate in scope with the following claims.

I claim:

1. A traverse rod system for one or more hanging objects, the traverse rod system comprising:

a tube having an opening slot disposed along its top surface; and a first trolley disposed within the tube, wherein the first trolley comprises a sled, a bearer, a ring, and a connector, wherein the sled is in contact with the bottom inner surface of the tube, the bearer is adjoined to the sled, the ring is adjoined to the bearer and at least partially encircles the tube, and the connector is adjoined to a bottom of the ring;

wherein the sled comprises a post at each end, each post having a raise strip that fits within the opening slot of the tube;

wherein the first trolley is configured to move back and forth within the tube, the first trolley bearing weight of the one or more hanging objects at a bottom inner surface of the tube via the sled, the bearer, the ring, and the connector.

2. The traverse rod system of claim 1, wherein the bearer, the ring, and the connector do not make contact with the tube.

3. The traverse rod system of claim 1, wherein the ring is selected from the group consisting of: a circular ring, a square shaped ring, a square shaped ring with rounded corners, a rectangular shaped ring, a rectangular shaped ring with rounded corners, and an oval ring.

4. The traverse rod system of claim 1, wherein the bearer extends through the opening slot.

5. The traverse rod system of claim 1, wherein the connector comprises one or more holes that can be used for attaching the one or more hanging objects.

6. The traverse rod system of claim 1, wherein a shape of a cross-section of the tube is selected from the group consisting of: a cylinder, a square, a square with rounded corners, a rectangle, and a rectangle with rounded corners.

7. The traverse rod system of claim 1, wherein the tube comprises a tongue configured to attach to one or more wall attachments.

8. The traverse rod system of claim 1, wherein the sled comprises one or more wheels.

9. The traverse rod system of claim 1, wherein the bearer is disposed in between the posts.

10. The traverse rod system of claim 1, wherein the bearer is also adjoined to a post and the bearer and the ring are disposed outside a space provided between the posts.

11. The traverse rod system of claim 1, further comprising a drapery ring, wherein the draper ring comprises a wheel coupled to the bearer, the wheel being able to freely move along the inner bottom surface of the tube.

* * * * *